US007045972B2

(12) United States Patent
Nishita

(10) Patent No.: US 7,045,972 B2
(45) Date of Patent: May 16, 2006

(54) LIGHTING METHOD OF ULTRA-HIGH PRESSURE MERCURY LAMP

(75) Inventor: Makoto Nishita, Shinagawa-ku (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/843,473

(22) Filed: May 12, 2004

(65) Prior Publication Data

US 2005/0093474 A1 May 5, 2005

(30) Foreign Application Priority Data

May 13, 2003 (JP) ..... 2003-134296

(51) Int. Cl.
*G05F 1/00* (2006.01)

(52) U.S. Cl. ..... 315/291; 315/360; 315/289; 315/307; 315/209 R; 315/DIG. 5; 315/DIG. 7

(58) Field of Classification Search ..... 315/289–291, 315/209 R, 247, 307, 360, 276, 287, 246, 315/DIG. 5, DIG. 7
See application file for complete search history.

(56) References Cited

U.S. PATENT DOCUMENTS

| | | | | |
|---|---|---|---|---|
| 5,051,665 | A * | 9/1991 | Garrison et al. | 315/287 |
| 6,597,118 | B1 * | 7/2003 | Arimoto et al. | 315/115 |
| 6,888,321 | B1 * | 5/2005 | Arimoto et al. | 315/289 |

FOREIGN PATENT DOCUMENTS

| | | | |
|---|---|---|---|
| JP | 06-076967 | A | 3/1994 |
| JP | 08-130096 | A | 5/1996 |
| JP | 2001-273984 | A | 10/2001 |
| JP | 2002-289379 | A | 10/2002 |

* cited by examiner

*Primary Examiner*—Haissa Philogene
(74) *Attorney, Agent, or Firm*—Sughrue Mion, PLLC

(57) ABSTRACT

A lighting device for an ac-lighting type ultra-high pressure mercury lamp includes: a stepdown chopper for converting dc voltage that is supplied from the outside to voltage of a prescribed level; a full-bridge switch circuit for generating either dc or ac voltage from the output voltage of the stepdown chopper and supplying the generated voltage to the ultra-high pressure mercury lamp; and a control circuit for controlling the full-bridge switch circuit such that, when extinguishing the lamp, a dc voltage is supplied over a prescribed time interval with a prescribed electrode of the ultra-high pressure mercury lamp as the anode.

8 Claims, 3 Drawing Sheets

LIGHTING METHOD OF ULTRA-HIGH PRESSURE MERCURY LAMP

BACKGROUND OF THE INVENTION

1. Field of the Invention

The present invention relates to a discharge lamp that is used as a light source in, for example, a projector, and more particularly to an ac-lighting type ultra-high pressure mercury lamp and to a lighting method.

2. Description of the Related Art

In an ac-lighting type of ultra-high pressure mercury lamp, lighting properties have a great influence on the characteristics of the lamp (life and luminance). For example, once lighted, the interior of the lamp reaches a high pressure, and the lamp is therefore extremely difficult to relight immediately after being extinguished. This deterioration of the lighting property both increases the consumption of the lamp electrode, this consumption being caused by sputtering that occurs when an arc-spot is formed, and tends to reduce luminance.

A lighting method is proposed in Japanese Patent Laid-Open Publication No. 2002-289379 for improving the lighting property when relighting a lamp. In this lighting method, during the course from the lit state to the extinguished state of an ultra-high pressure discharge lamp in which mercury is sealed inside an arc tube, the lamp power that is supplied to electrodes inside the arc tube is first reduced to a level such that the arc discharge is not extinguished, and after this reduced state is maintained for a set time period, the supply of current is cut off. This method both reduces the build-up of mercury on the surfaces of the two lamp electrodes and prevents consumption of the lamp electrodes caused by sputtering that occurs in the time interval from start-up until arc generation becomes stabilized.

One cause for the deterioration of the lighting property in an ac-lighting type of ultra-high pressure mercury lamp is the build-up of mercury on the electrodes when the lamp is extinguished. The state of build-up of mercury on the electrodes varies with such factors as the electrode configuration of the lamp, the distance between the electrodes and the inner surface of the bulb, and the rate of cooling. For example, metal components for incorporation in a reflector are provided on the side of one electrode in an ultra-high pressure mercury lamp, and the cooling of this electrode after the lamp is extinguished is therefore faster than the cooling of the other electrode. In this case, the build-up of mercury is advanced on the electrode that experiences faster cooling. In extreme cases, it is conceivable that all of the mercury will build up on one electrode. When most of the mercury builds up on one electrode in this way, the lamp tends not to light up smoothly.

In the lamp that is disclosed in the above-described patent document, the electrodes can be maintained at a particular temperature by maintaining the formation of the arc over a fixed time interval after the lamp is turned off, whereby nearly all of the mercury can be caused to build up on the inner surface of the bulb, which cools quickly. However, in this method there is the concern that chemical compounds will also be deposited when the mercury builds up on the inner surface of the bulb and thus diminish luminance.

SUMMARY OF THE INVENTION

It is an object of the present invention to provide a lighting device and a lighting method of an ac-type ultra-high pressure mercury lamp that can solve the above-described problems and that can easily improve the lighting property.

To achieve the above-described objects, the lighting device of the present invention is a lighting device of an ac-lighting type of ultra-high pressure mercury lamp and includes: a stepdown chopper for converting a dc voltage that is supplied from an outside to a voltage of a prescribed level; a full-bridge switch circuit for generating either a dc voltage or an ac voltage from the output voltage of the stepdown chopper and supplying this dc or ac voltage to the ultra-high pressure mercury lamp; and a control circuit for controlling the full-bridge switch circuit such that, when the lamp is extinguished, a dc voltage is supplied over a prescribed time interval with a prescribed electrode of the ultra-high pressure mercury lamp as an anode.

The lighting method of the present invention is a lighting method of an ac-lighting type of ultra-high pressure mercury lamp, and includes steps of: supplying an ac voltage to the ultra-high pressure mercury lamp and lighting the ultra-high pressure mercury lamp; and, when the ultra-high pressure mercury lamp that has been lighted is extinguished, supplying a dc voltage over a prescribed time interval with a prescribed electrode of the ultra-high pressure mercury lamp as an anode.

According to the present invention as described above, when a lamp is extinguished, a dc voltage is supplied over a prescribed time interval with a prescribed electrode of the ultra-high pressure mercury lamp as the anode. In this case, the prescribed electrode is the electrode that is provided closest to the metal components used for incorporation in a reflector. Due to this supply of a dc voltage, the temperature of the prescribed electrode (anode) immediately preceding extinguishment is higher than the temperature during normal ac operation, and further, higher than the temperature of the other electrode (cathode). Cooling of the prescribed electrode immediately after extinguishment is thus delayed to the extent of the increase in temperature. As a result, the time interval for cooling to the temperature at which build-up of mercury occurs is substantially the same for each electrode, and mercury therefore builds up equally on each of the electrodes. The amount of mercury that builds up on each electrode is therefore less than the unbalanced build-up of mercury on one electrode as noted in the previously described problem.

In addition, the present invention eliminates the concern that, when mercury builds up on each electrode at the time of extinguishing the lamp, the luminance of the lamp will be degraded by the build-up of chemical compounds on the inner walls of the bulb as noted regarding the above-described Japanese Patent Laid-Open Publication No. 2002-289379.

As described hereinabove, the present invention can reduce the amount of build-up of mercury on each electrode after the lamp is extinguished and thus exhibits the effects of improving the lighting property, and in particular, improving the relighting property.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
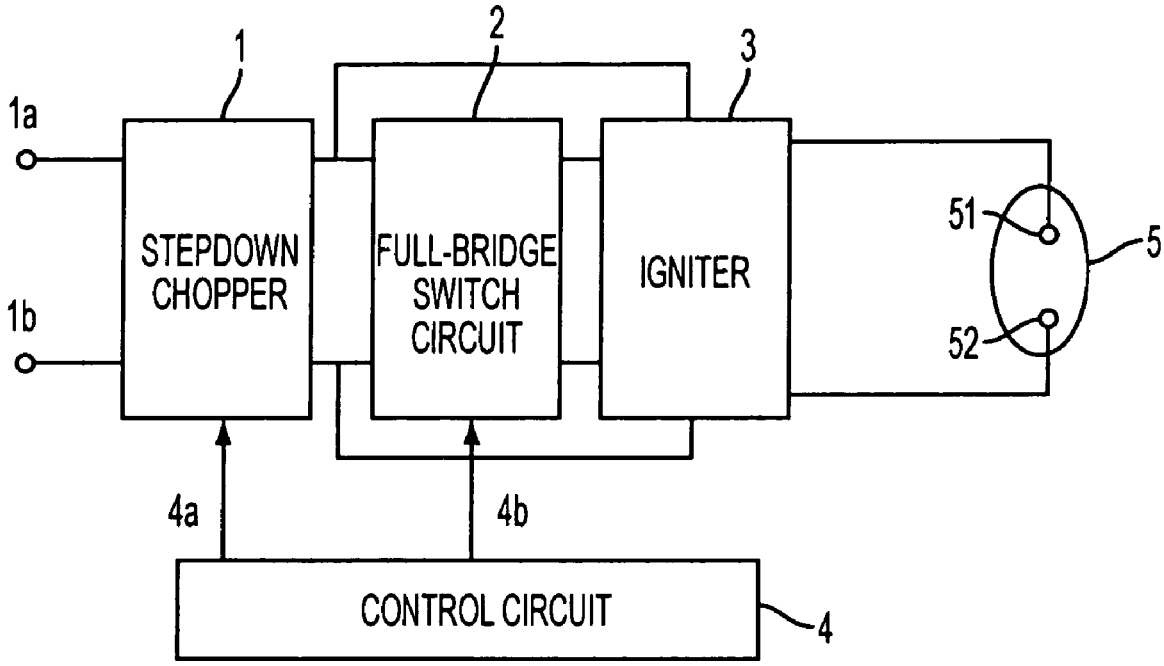
FIG. 1 is a block diagram showing the schematic configuration of an ac ballast device, which is an embodiment of the lighting device of the present invention.

FIG. 1 shows the schematic configuration of the ac ballast device that is an embodiment of the lighting device of the present invention. This ac ballast device is a device for lighting an ac-lighting type of ultra-high pressure mercury lamp 5 and is made up of: stepdown chopper 1, full-bridge switch circuit 2, igniter 3, and control circuit 4 for controlling these components.

Figure 2:
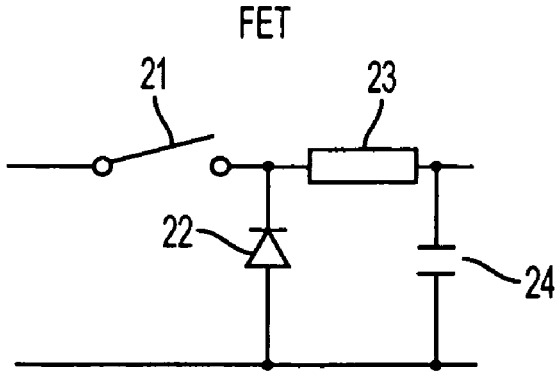
FIG. 2 is a circuit diagram showing the actual configuration of a stepdown chopper that forms a part of the ac ballast device that is shown in FIG. 1.

Stepdown chopper 1 is a device for converting a dc voltage that is supplied across input terminals 1*a* and 1*b* to the lamp voltage that is to be controlled, and the operation of this device is controlled by control signal 4*a* from control circuit 4. FIG. 2 shows the actual configuration of Stepdown chopper 1.

Referring to FIG. 2, stepdown chopper 1 is made up of: field-effect transistor (FET) 21, flywheel diode 22, choke coil 23, and capacitor 24. FET 21 and choke coil 23 are inserted in a series in the line that is connected to input terminal 1*a*. Flywheel diode 22 has its cathode connected to the line that connects the output side of FET 21 and the input side of choke coil 23 and has its anode connected to the line that is connected to input terminal 1*b*. Capacitor 24 is connected in parallel between the line to the output side of choke coil 23 and the line that is connected to input terminal 1*b*.

In the above-described stepdown chopper 1, FET 21 operates as a switch in accordance with control signal 4*a* from control circuit 4, and the output voltage of stepdown chopper 1 is thus controlled so as to supply uniform power to ultra-high pressure mercury lamp 5. The output voltage of stepdown chopper 1 when the lamp is not discharging is substantially equal to the voltage that is applied across input terminals 1*a* and 1*b*.

Figure 3:
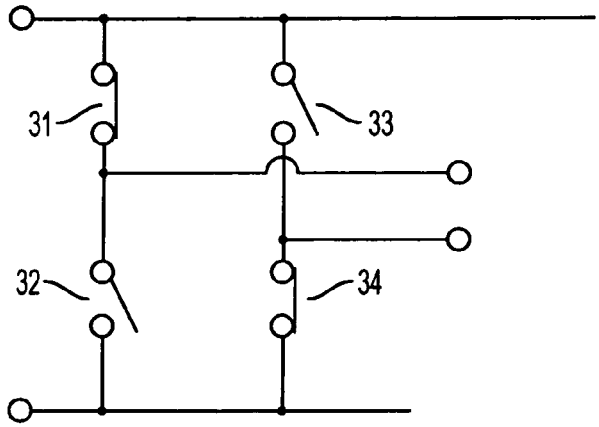
FIG. 3 is a circuit diagram showing the actual configuration of a full-bridge switch circuit that forms a part of the ac ballast device that is shown in FIG. 1.

Full-bridge switch circuit 2 takes the output voltage of stepdown chopper 1 and supplies a dc voltage and an ac voltage to ultra-high pressure mercury lamp 5. Full-bridge switch circuit 2 operates as a switch in accordance with control signal 4*b* from control circuit 4 and accordingly supplies dc voltage or ac voltage as output. FIG. 3 shows the actual configuration of full-bridge switch circuit 2.

Referring to FIG. 3, full-bridge switch circuit 2 is made up from the parallel connection of: serially connected FETs 31 and 32 and serially connected FETs 33 and 34. One end of each of FETs 31 and 33 is connected in common to one of the input lines of full-bridge switch circuit 2, and one end of each of FETs 32 and 34 is connected in common to the other input line. The other ends of FETs 31 and 32 are connected in common to one output line of full-bridge switch circuit 2, and the other ends of FETs 33 and 34 are connected in common to the other output line.

In the above-described full-bridge switch circuit 2, the switch operation of FETs 31–34 is controlled by control signal 4*b* of control circuit 4. If FETs 31 and 34 are both ON and FETs 32 and 33 both OFF, dc voltage (referred to as the "no-load voltage") from full-bridge switch circuit 2 is supplied as output, and a positive voltage is thus applied to electrode 51 and a negative voltage is applied to electrode 52 of ultra-high pressure mercury lamp 5. In contrast, when FETs 31 and 34 are both OFF and FETs 32 and 33 are both ON, a negative voltage is applied to electrode 51 and a positive voltage is applied to electrode 52 of ultra-high pressure mercury lamp 5. An ac voltage is supplied from full-bridge switch circuit 2 by the alternate switching between a first state in which FETs 31 and 34 are both ON and FETs 32 and 33 are both OFF and a second state in which FETs 31 and 34 are both OFF and FETs 32 and 33 are both ON.

Igniter 3 is provided for generating a high voltage for breaking the insulation and initiating discharge between electrodes 51 and 52 of ultra-high pressure mercury lamp 5. Control circuit 4 supplies control signal 4*a* to stepdown chopper 1 for controlling the switch operation of stepdown chopper 1, and supplies control signal 4*b* to full-bridge switch circuit 2 for controlling the operation of the switch operation of full-bridge switch circuit 2.

In the ac ballast device of the above-described embodiment, the operation for lighting ultra-high pressure mercury lamp 5 begins when an external control device not shown in the figures (for example, when applied in a projector, the control unit of the projector) supplies a lamp control signal (high-level state), and an extinguishing operation is performed for ending the lighting operation when the supply of the lamp control signal ceases (low-level state). The lighting operation and the extinguishing operation are controlled by control circuit 4.

Figure 4:
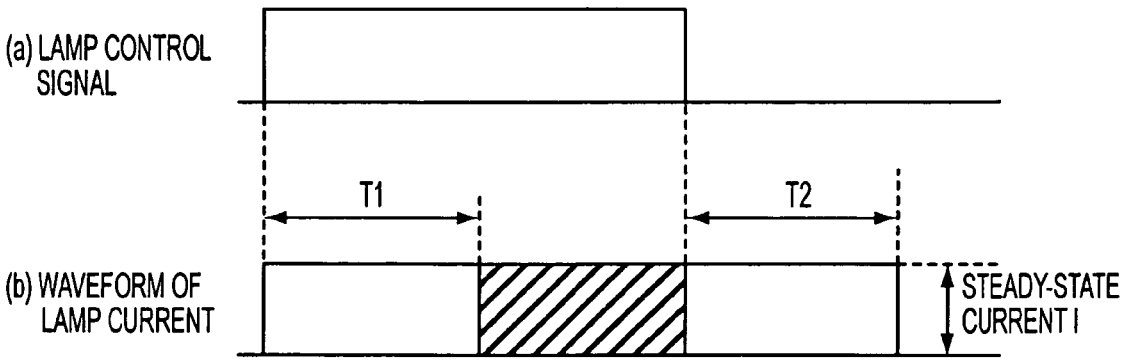
FIG. 4 is an explanatory view of the control of lighting and extinguishing in the ac ballast device that is shown in FIG. 1.

FIG. 4 shows an example of the control of lighting and extinguishing by control circuit 4. FIG. 4 shows lamp control signal (a) and the waveform (b) of the lamp current that is supplied to ultra-high pressure mercury lamp 5. The portion that is filled in with diagonal lines indicates the ac current control interval, and intervals T1 and T2 that precede and follow this interval indicate the intervals of fixed dc current control. The control of lighting and extinguishing by control circuit 4 is next explained with reference to FIGS. 1–4.

When the lamp control signal changes from low level to high level, ignition voltage (a pulse voltage for starting the lamp) that is generated by igniter 3 is supplied to ultra-high pressure mercury lamp 5 and the insulation between electrodes 51 and 52 is broken. Current then flows from electrode 51 to electrode 52 and the transition is made to arc discharge.

Upon the transition to arc discharge, the lamp is caused to operate at fixed dc current until the lamp discharge stabilizes, i.e., during interval T1. During the lamp operation at this fixed dc current, full-bridge switch circuit 2 is controlled such that a dc voltage is supplied to ultra-high pressure mercury lamp 5. It is here assumed that metal components for securing ultra-high pressure mercury lamp 5 to a reflector are provided near electrode 51, and the dc voltage is therefore supplied with electrode 51 as the anode and electrode 52 as the cathode.

After the passage of interval T1 and the stabilization of lamp discharge, full-bridge switch circuit 2 is controlled such that an ac voltage is supplied to ultra-high pressure mercury lamp 5 during the succeeding interval that precedes interval T2. Ultra-high pressure mercury lamp 5 is thus operated by an ac current.

When the lamp control signal makes the transition from high level to low level, the lamp is operated at a fixed dc current during interval T2. Lamp operation at this fixed dc current is carried out similar to the operation in the above-described interval T1. In this case as well, electrode 51 is the anode and electrode 52 is the cathode.

According to the above-described lamp operation, when extinguishing the lamp, the lamp is operated at a fixed dc current over a prescribed time period, whereby the lighting property when restarting the lamp (relighting property) is improved. The reasons for this improvement are next explained.

Ultra-high pressure mercury lamp 5 is provided with metal components on the electrode 51 side for incorporation with a reflector, and the cooling rate after the lamp is extinguished is therefore different for electrodes 51 and 52. In this case, the electrode 51 side cools faster than the electrode 52 side. The build-up of mercury on electrodes that occurs after the lamp is extinguished and that is the cause for the deterioration of the relighting property progresses at a higher rate on the more rapidly cooling electrode 51 side, and it is possible that in extreme cases, all of the mercury will build up on the electrode 51 side. When a large amount of mercury builds up on one electrode in this way, the relighting property deteriorates.

In order to improve the relighting property, mercury must build up on both electrodes 51 and 52 evenly. When extinguishing the lamp with the ac ballast device of the present embodiment, the lamp is operated at a fixed dc current over a prescribed time interval with electrode 51 as the anode and electrode 52 as the cathode. In this case, the temperature on the electrode 51 side, which is the anode, immediately before extinguishing is higher than the temperature during operation at the steady-state current (corresponding to the portion shaded by diagonal lines in FIG. 4), and further, higher than the electrode 52, or cathode side. The cooling of electrode 51 after the lamp is extinguished is thus delayed in accordance with the higher temperature, and as a result, the cooling time required to reach the temperature at which the build-up of mercury occurs is substantially equal for each of electrodes 51 and 52, and mercury builds up evenly on each of electrodes 51 and 52. The amount of mercury that builds up on each electrode is therefore less than when lamp operation at a dc current is not carried out when extinguishing the lamp, and the relighting property is therefore improved.

In the ac ballast device of the above-described present embodiment, an already existing microcomputer can be employed as control circuit 4 and the control of the current that is supplied to ultra-high pressure mercury lamp 5 can be realized by a program. In the present embodiment, lamp operation by the fixed dc current at the time of starting lighting and lamp operation by the fixed dc current at the time of extinguishing the lamp can be realized by the same control. As are result, the same program can be applied, and the control can therefore be kept simple and costs can be kept low.

In addition, the intervals T1 and T2 that are shown in FIG. 4 are preferably set as appropriate with due consideration given to the such factors as the electrode configuration of the lamp, the distance between the inner surface of the bulb and the electrodes, and the cooling rate.

Another Embodiment

Figure 5:
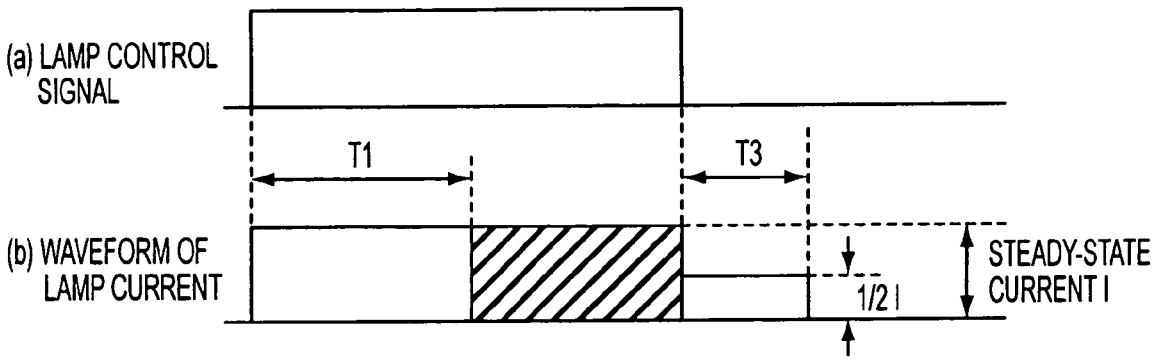
FIG. 5 is an explanatory view of the control of lighting and extinguishing in the ac ballast device that is another embodiment of the present invention.

The present embodiment is equivalent to the above-described embodiment with the exception that, in the lamp operation that is carried out at a fixed dc current when extinguishing the lamp, the amount of current that flows across electrodes 51 and 52 of ultra-high pressure mercury lamp 5 is set to one-half the steady-state current. FIG. 5 shows an example of this current control. FIG. 5 shows the lamp control signal (a) and the waveform (b) of the lamp current that is supplied to ultra-high pressure mercury lamp 5. The portion that is filled in by diagonal lines shows the control interval by ac current, and the preceding and succeeding intervals T1 and T3 show control intervals by a fixed dc current. Operation in interval T1 and the shaded portion are equivalent to the operation in FIG. 4.

In the present embodiment, the lamp is operated by a fixed dc current with electrode 51 as the anode and electrode 52 as the cathode during interval T3 when the lamp control signal changes from high level to low level, but the current that is supplied to electrodes 51 and 52 is one-half the steady-state current. Here, the steady-state current is the current that flows when the lamp is in a stabilized state, and in concrete terms, is the current that flows across electrodes 51 and 52 of ultra-high pressure mercury lamp 5 during the interval in which the ac voltage in the shaded portion of FIG. 5 is supplied. As a result of this operation, the area of the arc spot (arc bright point) becomes smaller and the temperature of the electrode tip portion becomes higher than during supply of the steady-state current. This means that the cooling of the electrodes after extinguishing the lamp can be more greatly delayed than in the example shown in FIG. 4.

In addition, interval T3 of lamp operation at the fixed dc current that is carried out when extinguishing the lamp is shorter than interval T2 of the example shown in FIG. 4, and as a result, the time period from the time that the lamp control signal changes to low level until the lamp is extinguished, i.e., the time from the point that the user performs the operation of stopping the lamp until the lamp is extinguished, can be reduced, and the operability can therefore be improved.

The current control such as shown in FIG. 5 can be easily realized by merely modifying the program of an already existing microcomputer.

Although the amount of current that is supplied to electrodes 51 and 52 in lamp operation at the fixed dc current during interval T3 is one-half the steady-state current in the above-described embodiment, the present invention is not restricted to this form, and any value may be used that is less than the steady-state current and that decreases the area of the arc spot. However, if the amount of current is reduced excessively, the arc spot does not form and is lost, and the electrode therefore cannot be heated. Thus, as a minimum, the amount of current must be set within a range that allows formation of the arc spot. It was found through experimentation that setting the amount of current to one-half the steady-state current obtained good electrode heating without loss of the arc spot. Because there is some concern that the arc spot will be lost if the amount of current is set to less than one-half the steady-state current, the amount of current is preferably set to at least one-half the steady-state current.

In addition to an ultra-high pressure mercury lamp, the ac ballast device of each of the above-described embodiments can be applied in other discharge lamps such as HID lamps (High-Intensity Discharge lamps) represented by metal halide lamps or mercury lamps in which light is emitted by discharge in a metal vapor, and in such cases, the ac ballast device can similarly improve relighting property.

While preferred embodiments of the present invention have been described using specific terms, such description is for illustrative purposes only, and it is to be understood that changes and variations may be made without departing from the spirit or scope of the following claims.

What is claimed is:

1. A lighting device for an ac-lighting type of ultra-high pressure mercury lamp, comprising:

a stepdown chopper for converting a dc voltage that is supplied from an outside to a voltage of a prescribed level;

a full-bridge switch circuit capable of generating a dc voltage and an ac voltage from output voltage of said stepdown chopper for supplying generated voltage to said ultra-high pressure mercury lamp; and a control circuit for controlling said full-bridge switch circuit such that, when extinguishing the lamp, a dc voltage is supplied over a prescribed time interval with a prescribed electrode of said ultra-high pressure mercury lamp as an anode.

2. A lighting device according to claim 1, wherein, when lighting the lamp, said control circuit controls said full-bridge switch circuit such that a dc voltage is supplied over a prescribed time interval with a prescribed electrode of said ultra-high pressure mercury lamp as an anode.

3. A lighting device according to claim 2, wherein:

said control circuit controls said full-bridge switch circuit such that an ac voltage is supplied to said ultra-high pressure mercury lamp after supplying said dc voltage during said lighting; and a value of current that flows across electrodes of said ultra-high pressure mercury lamp when said dc voltage is supplied during said extinguishing is lower than a value of a steady-state current that flows across electrodes of said ultra-high pressure mercury lamp when said ac voltage is supplied.

4. A lighting device according to claim 3, wherein the value of current that flows across electrodes of said ultra-high pressure mercury lamp when said dc voltage is supplied during said extinguishing is half the value of said steady-state current.

5. A lighting method of an ac-lighting type of ultra-high pressure mercury lamp, comprising the steps of:

supplying an ac voltage to said ultra-high pressure mercury lamp and lighting said ultra-high pressure mercury lamp; and when extinguishing said ultra-high pressure mercury lamp that has been lighted, supplying a dc voltage over a prescribed time interval with a prescribed electrode of said ultra-high pressure mercury lamp as an anode.

6. A lighting method according to claim 5, further comprising the step of, when lighting said ultra-high pressure mercury lamp, supplying a dc voltage over a prescribed time interval with said prescribed electrode as an anode.

7. A lighting method according to claim 5, wherein a value of current that flows across electrodes of said ultra-high pressure mercury lamp when said dc voltage is supplied during said extinguishing is smaller than a value of a steady-state current that flows across the electrodes of said ultra-high pressure mercury lamp when said ac current is supplied.

8. A lighting method according to claim 7, wherein the value of current that flows across electrodes of said ultra-high pressure mercury lamp when said dc voltage is supplied during said extinguishing is half the value of said steady-state current.

* * * * *